United States Patent [19]

Theis

[11] Patent Number: 4,688,637

[45] Date of Patent: Aug. 25, 1987

[54] METHOD FOR INDUCED FLOW RECOVERY OF SHALLOW CRUDE OIL DEPOSITS

[76] Inventor: Ralph W. Theis, 323 Whisper Wood, San Antonio, Tex. 78216

[21] Appl. No.: 19,635

[22] Filed: Feb. 27, 1987

[51] Int. Cl.[4] ..... E21B 43/24; E21B 43/263; E21B 43/30; E21B 47/06

[52] U.S. Cl. ..... 166/245; 166/252; 166/263; 166/271; 166/272; 166/299; 166/370; 166/79; 166/222

[58] Field of Search ..... 166/245, 247, 252, 263, 166/271, 272, 299, 303, 369, 370, 222; 299/2, 13

[56] References Cited

U.S. PATENT DOCUMENTS

| | | | |
|---|---|---|---|
| 461,445 | 10/1891 | Monjeau | 166/272 |
| 1,726,041 | 8/1929 | Powell | 166/272 X |
| 2,286,724 | 6/1942 | Garrison | 166/303 |
| 2,630,182 | 3/1953 | Klotz, Jr. | 166/271 |
| 2,756,826 | 7/1956 | Ebaugh | 166/299 |
| 3,007,520 | 11/1961 | Frey | 166/245 X |
| 3,285,335 | 11/1966 | Reistle, Jr. . | |
| 3,357,487 | 12/1967 | Gilchrist et al. | 166/272 X |
| 3,372,750 | 3/1968 | Satter et al. | 166/272 |
| 3,385,359 | 5/1968 | Offeringa | 166/272 |
| 3,402,770 | 9/1968 | Messenger | 166/272 X |
| 3,437,146 | 4/1969 | Everhart et al. | 166/303 |
| 3,441,083 | 4/1969 | Fitzgerald | 166/245 |
| 3,674,089 | 7/1972 | Moore | 166/299 X |
| 3,759,328 | 9/1973 | Ueber | 166/303 |
| 3,794,113 | 2/1974 | Strange | 166/272 X |
| 3,850,241 | 11/1974 | Hutchison | 166/222 |
| 4,046,199 | 9/1977 | Tafoya | 166/222 X |
| 4,101,172 | 7/1978 | Rabbitts | 166/271 X |
| 4,109,719 | 8/1978 | Martin et al. | 166/299 X |
| 4,185,693 | 1/1980 | Crumb et al. | 166/263 X |
| 4,289,354 | 9/1981 | Zakiewicz | 299/2 X |
| 4,345,647 | 8/1982 | Carmichael | 166/370 X |
| 4,407,367 | 10/1983 | Kydd | 166/303 X |
| 4,456,065 | 6/1984 | Heim et al. | 166/272 X |
| 4,465,136 | 8/1984 | Troutman | 166/245 X |
| 4,508,389 | 4/1985 | Hodges | 166/245 X |

*Primary Examiner*—George A. Suchfield
*Attorney, Agent, or Firm*—Gunn, Lee & Jackson

[57] ABSTRACT

A method to enhance oil production from producing formations using a pressure differential created by evacuating a recovery hole cased through the overburden into the producing formation, and directionally injecting under pressure, into an injection hole in communication with the producing formation, a heated hydrocarbon solvent with surfactant added a distance from the recovery hole. The heat, solvent, pressure differential and surfactant will increase the flow of crude into the recovery hole.

17 Claims, 3 Drawing Figures

METHOD FOR INDUCED FLOW RECOVERY OF SHALLOW CRUDE OIL DEPOSITS

FIELD OF THE INVENTION

The present invention relates to a process to enhance the recovery of crude oil and, more particularly, to a process of enhancing the flow of crude oil through a formation from injection holes to a recovery well.

BACKGROUND OF THE INVENTION

Many oil wells are subject to greatly reduced natural production as a result of heavy, low gravity crude oil deposits being combined with low porosity sands in the producing formation. In such shallow formations, crude oil is in equilibrium, and no natural differential pressure exists to drive the crude oil up to the surface. As a result, when crude oil is removed from a recovery well, high viscosity of the oil and low porosity of the formation prevent migration of the crude from the surrounding formation into the recovery well. The high pressure that exists in many deep wells usually does not exist in the shallower wells, such wells being within about one thousand feet of the surface. There are, however, many such stabilized, heavy crude oil deposits to be found in shallow formations. An example of such a heavy crude oil deposit can be found in the shallow San Miguel formation in the central part of Maverick County, northeast of the town of Eagle Pass, Texas.

Structurally, the shallow San Miguel formation is located on the northern, or tip portion of the Chittim anticline. The Olmos formation and underlying San Miguel formation outcrop over the northern portion of the Chittim anticline. This circumstance results in the oil-bearing reservoir sands within the shallow San Miguel formation lying as close as forty feet below the surface of the earth in many areas.

The San Miguel sands are estimated to contain in excess of one hundred one million barrels of heavy crude oil low in sulfur and ranging in gravity from about 10° A.P.I. to 20° A.P.I. depending upon depth. About half the heavy crude lies within one hundred feet of the surface of the earth.

Two methods have been used in an attempt to remove crude oil from the San Miguel sands. An in situ combustion project was attempted. Combustion was supported by injecting air through input wells. The project was abandoned when no significant quantity of oil was produced. In addition, steam injection was attempted with similar dissappointing results.

The prior art includes a number of patents related to the recovery of oil. For example, U.S. Pat. No. 2,286,724 (Garrison) discloses the heat treatment of an oil well by first heating wet sand above the producing formation to the boiling point of water to dehydrate the sand around the well. Garrison proposes heating to be done by an electric heater lowered into the well. Following deydration, the sand grains are coated with an oil wettable material. This converts an oil well that has contained water wet producing sand to one that is wettable by oil, and thereby increases the ratio of oil to water in the producing sand. By dehydrating the wet sand, oil can flow through the capillaries and crevices of the producing sand.

U.S. Pat. No. 3,385,359 (Offeringa, 1968) discloses a method for producing oil from a sub-surface producing formation that consists of very high viscosity tar-bearing sands. The method consists of injecting hot water into the formation, waiting for the formation to heat, then injecting steam and other condensable liquids into the formation. The viscosity of the tar is lowered, and it can be removed. Offeringa also discloses fracturing to reduce the pressure required to inject the water into the formation.

U.S. Pat. No. 3,372,750 (Satter et al., 1968) discloses a method directed to an environment in which oil sands overlay water-bearing sands. In Satter, heat is applied to a large volume of oil while steam is simultaneously used to a reduce viscosity and force migration to a recovery well.

Yet another method of enhancing crude oil recovery using heat is disclosed in U.S. Pat. No. 3,441,083 (Fitzgerald 1969). This method uses both steam drive and in situ combustion techniques in combination with a specific spacing between air and steam injection wells. In Fitzgerald, production wells surround a plurality of steam and air injection wells. Heat and pressure are created by in situ combustion at the top of the formation. Heat and fluid flow is initiated from the injection well to the production well by steam injection in the lower portion of the producing formation. This, in conjunction with gravity and thermal expansion, causes the crude oil to flow downward to the production wells. This method also anticipates fracturing of the producing formation near the bottom before steam injection.

Prior art also discloses processes for recovery of liquids other than liquid hydrocarbons from underground. For example, U.S. Pat. No. 3,759,328 (Ueber 1973) features a method for removing hydrocarbons from oil shale. This method discloses an underground cavern which is continually evacuated and in which shattered and crumbled oil shale is pyrolyzed, releasing hydrocarbons thereby. Pumps are used to inject steam and hot liquids, as well as to remove gas and fluid from the pyrolyzed shale in the underground chamber.

U.S. Pat. No. 461,445 (Monjeau 1891) discloses a process for forming subterranean filtering chambers for the recovery of clean water. The invention relates to enlarging subterranean areas to increase the amount of water obtainable from them. The method involves the injection into the well of steam in conjunction with hammering and thereby loosening particles of sand and gravel which are then removed by pumping.

SUMMARY OF THE INVENTION

The process consists of selecting a favorable site, such site determined by taking a full depth core for evaluation purposes. Assuming satisfactory core results, these core holes will become pilot holes for each recovery well. At the chosen location, a recovery well is drilled through the overburden into the bottom of the producing formation. Three shot holes are then drilled to the bottom of the producing formation in a triangular pattern around the recovery well. The shot holes are filled with a suitable blasting charge and a cast primer, and subsequently stemmed to the surface. The three shots are detonated simultaneously into the recovery well in the producing formation. The rubble that has been blasted loose is cleaned out as much as possible to increase the size of the recovery chamber. This will provide a place for crude oil to pool and also facilitate its pumping.

A fabricated casinghead is set in place on a cemented casing which extends into at least the top of the producing formation. A vacuum pump, submersible pump and monitoring instrumentation are hooked up and commissioned.

Approximately thirty to sixty feet away from the recovery well, injection holes are drilled into the producing formation, charges inserted, holes stemmed and blasted. The injection holes are then redrilled, and hot diesel fuel with a surfactant added is injected through injection lines lowered into each injection hole. The injection in each hole will sweep the producing formation in a half circle from a tangent on the circle towards the central casing and through the full depth of the formation. The heat of the diesel fuel will lower the viscosity of the crude oil, and the diesel fuel itself will slightly improve the gravity of the crude oil, with a surfactant included to promote separation of the oil from the formation water.

Vacuum of up to 25 inches of mercury will be drawn in the central casing to promote the flow of stimulated crude oil towards it.

All of these techniques will stimulate the flow of crude oil that previously was in equilibrium in the producing formation.

It is, therefore, the object of the present invention to initiate and enhance the flow of crude oil through a producing formation. More specifically, it is the object of the present invention to enhance the flow of crude oil through a producing formation from an injection well to a recovery well.

It is a further object of the present invention to initiate or enhance oil flow through a producing formation by the injection of a high pressure hydrocarbon solvent through an injection well to a recovery well which has been partially evacuated of air.

It is a further object of the present invention to enhance the flow of crude oil through a producing formation by fracturing the producing formation prior to imposing a pressure differential through the injection of a high temperature hydrocarbon solvent at an injection well and the evacuation of a central recovery well.

It is yet another object of the present invention to enhance the migration of crude oil through producing formation by utilizing hot hydrocarbon solvent mixed with a suitable surfactant to break down water-crude oil bond.

It is yet another object of the present invention to combine the aforementioned steps of heating, injecting, fracturing, and evacuating to enhance recovery of crude oil in a producing formation.

DESCRIPTION OF THE PREFERRED EMBODIMENT

Before the enhanced recovery process is begun, a suitable location must be found. In evaluating a proposed location, full depth cores should be taken. If the results are satisfactory, the core holes may become pilot holes for each central recovery well 18.

Figure 1:
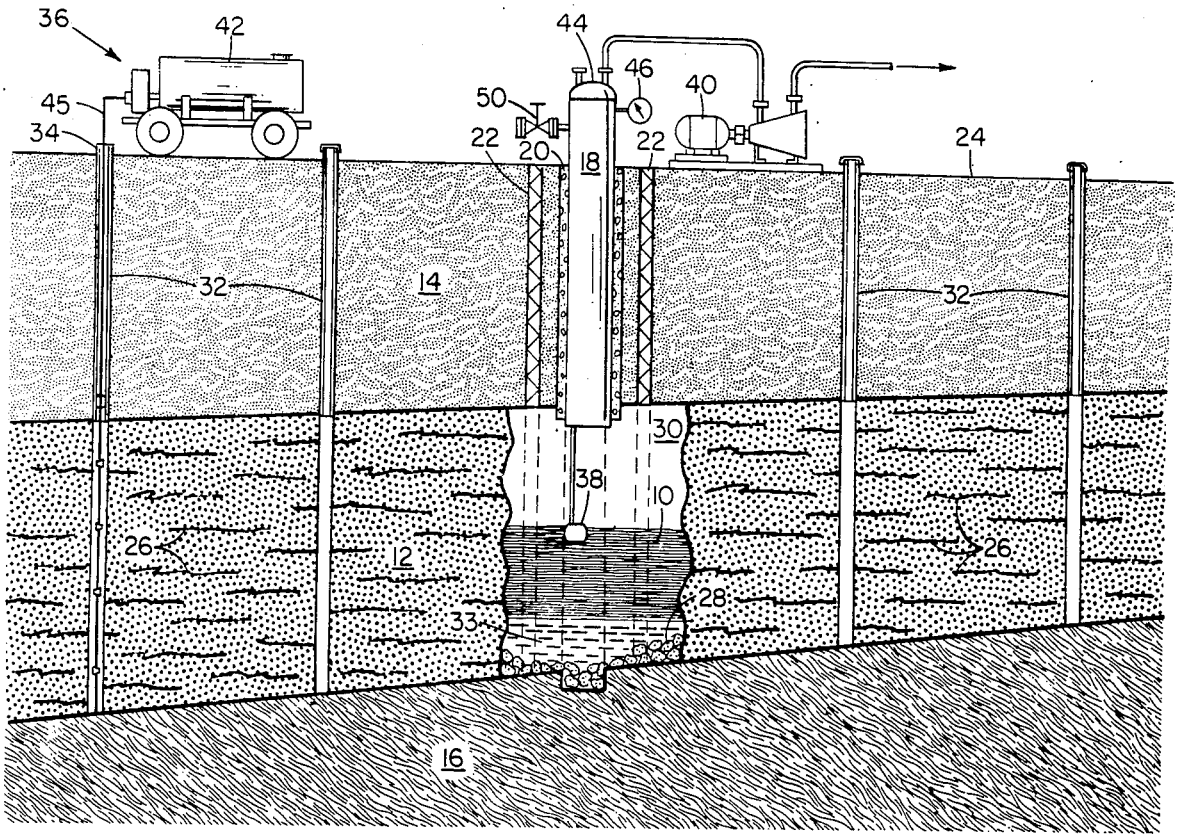
FIG. 1 is a cross-section of a producing formation as it exists when the enhanced oil recovery process is in operation.

FIG. 1 illustrates the main features of the enhanced recovery process. To illustrate its application, assume crude oil 10 has been discovered in producing formation 12. However, because of high viscosity or other properties of crude oil 10, limited porosity in producing formation 12, and the shallow depth of producing formation 12, very little natural pressure exists to drive crude oil 10. Producing formation 12, therefore, is an excellent candidate for the enhanced recovery process. Producing formation 12 may be overlain by overburden 14, and underlain by underlying formation 16. For the sake of illustration, overburden 14 in FIG. 1 is limestone, producing formation 12 is sandstone, and underlying formation 14 is an impervious clay. Crude oil 10 is trapped within producing formation 12 by the impervious underlying formation 16.

As can be seen in FIG. 1, a number of drill holes penetrate producing formation 12. First, central recovery well 18 is drilled into the top of producing formation 12. In the preferred embodiment recovery well 18 is drilled through overburden 14 to a 24 inch diameter. It is from recovery well 18 that crude oil 10 will be withdrawn. After drilling recovery well 18 a casing 20, preferably made of steel, is set from the surface of the ground through overburden 14 and partially into producing formation 12. Preferably, casing 20 has an exterior diameter of 20 inches. Next, recovery well 18 is drilled approximately 18 inches in diameter through producing formation 12 into underlying formation 16.

Following the drilling of recovery well 18 and the setting of casing 20, shot holes 22 are drilled through overburden 14 and into producing formation 12. While the drilling diameter of recovery well 18 is generally in the order of 24 to 30 inches, shot holes need only be large enough to insert a blasting charge, preferably about 6½ inches in diameter. Shot holes 22 are drilled within a close proximity to recovery well 18. Generally, shot holes 22 will be drilled within a 12-foot diameter of where the longitudinal axis of recovery well 18 intersects plane of surface 24.

The next step is a first blasting. Charges are inserted into producing formation 12 through shot holes 22. Following insertion of the blasting charges into producing formation 12, shot holes 22 are permanently stemmed from the top of producing formation 12 to surface 24. The stemming of shot holes 22 will prevent the escape of the blasting charge and debris during detonation. The charges will be packed into producing formation 12.

When the blasting charges are detonated, producing formation 12 is heavily fractured. Fractures 26 act as fluid channels for the migration of crude oil 10. In addition, detonating a blasting charge of sufficient magnitude will create rubble 28. Rubble 28 is illustrated underlying chamber 30. That is, after the first blasting, rubble 28 is physically removed from producing formation 12 to create chamber 30. Rubble 28 may be removed using drill bits that are known in the art, or by other mechanical means, such as tongs, grappling hooks, vacuum systems or a shallow pitch auger. For the sake of illustration, some rubble 28 is left in the bottom of chamber 30.

The purpose of the first blasting through shot holes 22 into recovery well 18 is two-fold. First, numerous fractures 26 are created which improves the flow of crude oil 10 through producing formation 12 by increasing the flow face. Second, the first blasting produces rubble 28 which may be removed from chamber 30 to create a vessel for the collection of crude oil 10 and underlying water 33. One example of an appropriate blasting charge is ANFO-Nitropel with a cast primer, though other charges are suitable.

It should be noted that the enhanced oil recovery process does not require shot holes 22. The purpose of shot holes 22 is to increase the volume of chamber 30 by introducing blasting charges several places within producing formation 12. That is, the use of shot holes 22 produces a larger chamber 30. The magnitude of the blasting charge and the location of shot holes 22 will help determine the amount of rubble 28 created and when removed, the size of chamber 30. The magnitude of blasting charge required will be a function of the type of charge and the manner it is used, as well as the properties of producing formation 12. In addition to blasting to create chamber 30, hydraulic fracturing or bell footing drilling techniques are appropriate for shallow formations.

Figure 2:
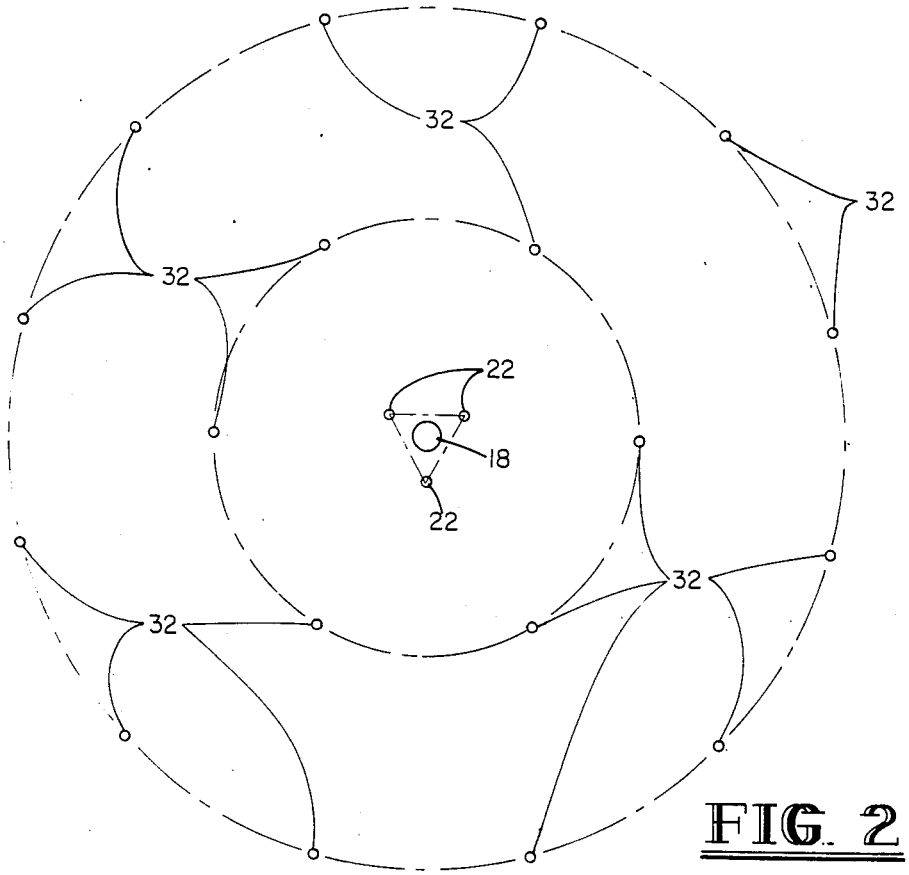
FIG. 2 is an overhead view of the surface of the ground and the location of drill noles when the enhanced oil recovery process is in operation.

As can be seen in FIG. 2, three shot holes 22 are drilled equally spaced along the circumference of a circle transcribed by a radius of 6 feet originating at the longitudinal axis of casing 20 where said longitudinal axis intersects surface 24. This distance, however, would vary with the properties of producing formation 12, magnitude of blasting charge, and size of evacuated chamber 30 desired.

The enhanced oil recovery process also requires drilling of at least one injection hole 32. Injection holes 32 are drilled at least partially into producing formation 12. In the preferred embodiment a plurality of injection holes 32 are drilled along the circumference of a circle extending outward from an origin located at the intersection of longitudinal axis of recovery well 18 and surface 24. This is illustrated in FIG. 2. The radius to first injection holes 32 is preferably 30 feet, and the radius to second injection holes 32 is 60 feet. These distances will vary with properties of producing formation 12. While FIG. 2 illustrates a circular pattern for injection holes 32, other patterns may be suitable, depending upon the properties of the formation. After flow of crude oil 10 is established, radii of injection holes 32 will increase in 30 foot increments.

Following drilling of injection holes 32, blasting charges are set within producing formation 12 and injection holes 32 are stemmed. A second blasting in producing formation 12 is then performed. The second blasting may be either simultaneous or sequential. That is, all charges may be fired simultaneously, or sequentially. The purpose of this blasting is to promote fracturing and gas generation in producing formation 12 and thereby create a free flow of crude oil 10 therethrough. In the preferred embodiment, sequential blasting promotes shock waves which assist in gas generation and fracturing of producing formation 12. When blasting sequentially, the charges closest to recovery well 18 are fired first, and the charges farthest away are fired last. Such sequential blasting focuses the blast's percussion at recovery well 18.

Following the second blasting, injection holes 32 are redrilled. Following redrilling, sleeves 34 are inserted at least through overburden 14. In the preferred embodiment, 5½ inch steel is used for sleeve 34. At this stage, the physical drilling is completed.

Figure 3:
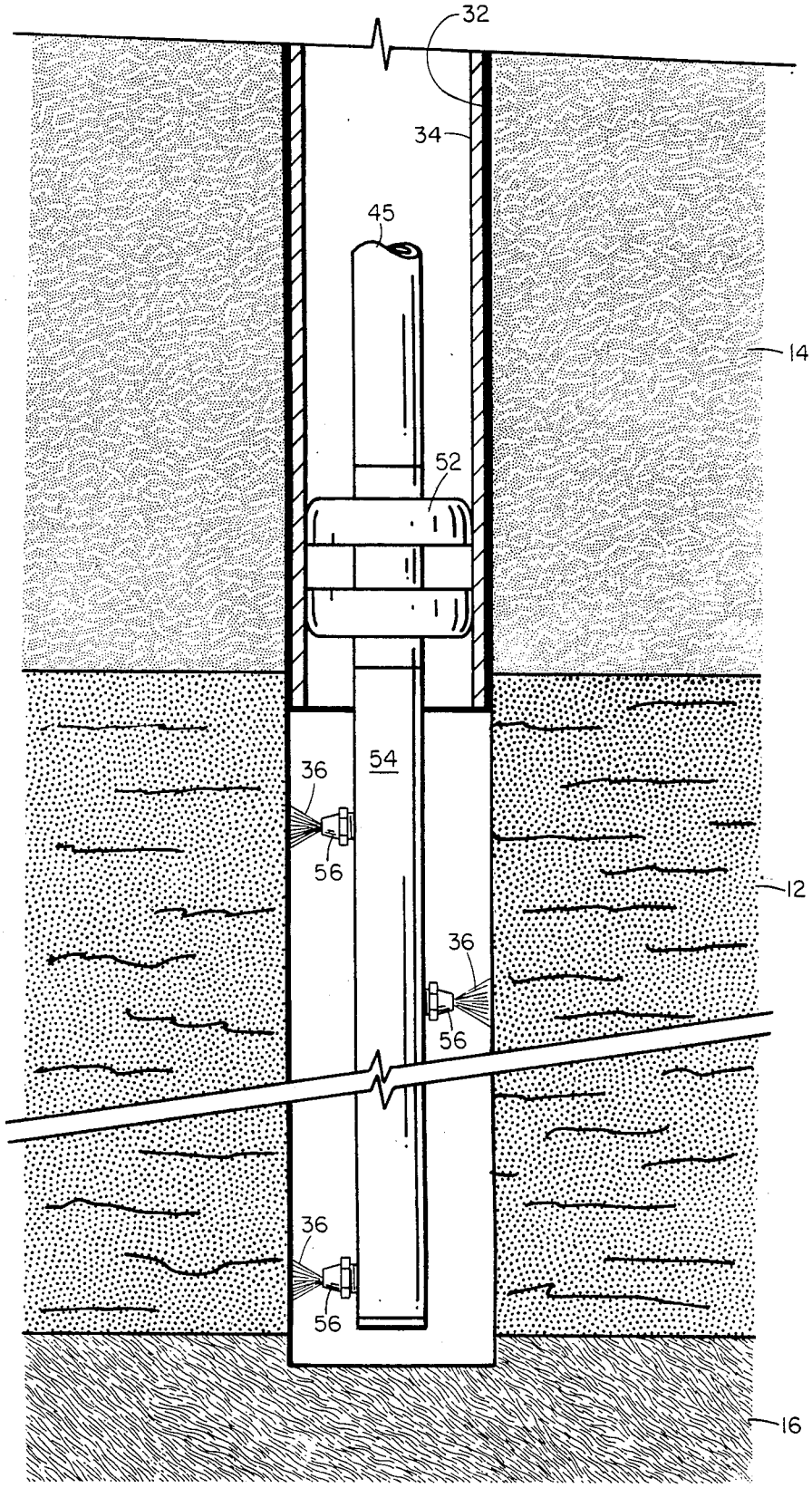
FIG. 3 is an enlarged cross-section of an injection hole illustrating the injecting line as it crosses from the overburden through the producing formation.

The next step is to begin the recovery of crude oil 10. FIG. 1 and FIG. 3 are sufficient to illustrate the post-drilling steps required to produce crude oil 10 from producing formation 12. In brief overview, the recovery process requires the introduction by pressure injection of a hot, liquid hydrocarbon solvent/surfactant mixture through injection holes 32 into producing formation 12, evacuation by vacuum pump of chamber 30, and (optionally) using pump 38 to remove crude oil 10 pooled in chamber 30. The overall effect of the combination of the aforementioned, is to force crude oil 10 to migrate through producing formation 12, assisted by blast-created flow channels. The migration of crude oil 10 to evacuated chamber 30 is enhanced by the pressure differential created by the injection of hot, hydrocarbon solvent 36 under pressure through injection holes 32 combined with the vacuum created in chamber 30 by vacuum pump 40. The heating of hydrocarbon solvent 36 assists in lowering viscosity of crude oil 10 by raising its temperature. In preferred embodiment hydrocarbon solvent 36 is diesel fuel but other solvents may be used depending upon crude oil and formation properties. By using liquid hydrocarbon solvent 36, the viscosity of crude oil 10 is further decreased and the flow thereby increased.

Injection of hydrocarbon solvent 36 is performed by injection unit 42. Suitable injection units 42 are available through Bohanan Hot Oil Services, Jourdanton, Texas. Injection unit 42 heats diesel fuel and pumps it under pressure to a delivery point. In the preferred embodiment, hydrocarbon solvent 36 is injected at pressures up to 6,000 p.s.i. and a temperature of up to 250° F. The amount of solvent 36 injected into each hole preferably is a minimum of 5% and a maximum of 10% of the calculated volume of crude oil 10 in the formation swept from each injection hole 32. Optionally, a surfactant can be mixed with hydrocarbon solvent 36 prior to injection. A suitable surfactant is Hyflo IV (available through Halliburton Services, Duncan, Okla. 73536), a blend of oil soluble surfactants designed to help break water blocks and reduce the crude oil/water emulsions. By reducing interfacial tension and film viscosity between formation brines and crude oil 10, crude oil 10 flow is enhanced.

FIG. 3 shows injector line 45 connected to solvent injection/heater unit 42. Line 45 extends down through sleeved injector holes 32 and producing formation 12. Injector line 45 is attached to packer 52 which is affixed to spray nozzle assembly 54 which, in turn, extends into producing formation 12. Spray nozzles 56 are adapted to spray pressurized hydrocarbon solvent 36 in a variety of spray patterns. Nozzles 56 can spray sheets, cones, needles, or any other pattern desired. A source of different types of injector nozzles is Spraying Systems Co., Wheaton, Ill. 60188. In the preferred embodiment, numerous spray nozzles 56 are connected along nozzle assembly 54 below where injector line 44 is attached to packer 52. Injector line 44 and nozzle assembly 54 are capable of being rotated. This rotational feature allows injector spray nozzles 56 to direct spray. Spray nozzle assembly 54 may also be raised and lowered from surface 24 to allow injecting of entire producing formation 12. In the preferred embodiment, the injection is first directed toward chamber 30. Then, hydrocarbon solvent 36 may be sprayed in a 360° circle. The purpose of such directional injection is to initiate the migrating of crude oil 10 towards chamber 30.

Packer 52 will be inserted into injection well 32 seated at a point just above the interface of overburden 14 and producing formation 12. By using packer 52 with an outer diameter pressing firmly against inner diameter of sleeve 34 and an inner diameter of packer 52 carrying injector line 44 above and spray nozzle assembly 54 below, an effective seal is created between overburden 14 and producing formation 12. This seal allows restriction of pressure created by injector unit 42 to within producing formation 12 and prohibits backflow of solvent 36 up injection hole 32. An example of one such packer 52 is the Otis CP Packer with opposing cups designed to seal in both directions.

Recovery well 18 is sealed with casinghead 44. Gauges and monitoring instrumentation 46 are connected in communication with recovery well 18. Gauges and monitoring instrumentation 46 detect temperature (degrees F.), pressure (pounds per square inch and vacuum inches of mercury), hydrogen sulfide ($H_2S$) and oxygen ($O_2$). These gauges and sensors are commercially available.

Vacuum pump 40 is connected with casinghead 44 to draw vacuum in recovery well 18. An example of a suitable vacuum pump is the Sogevac Rotary Vane Pump designed to produce at least 25 inches of mercury vacuum at a pumping capacity of approximately 375 cubic feet per minute. It is important that pump 40 is designed with blow-out protection for a sudden increase in pressure. In the preferred embodiment, vacuum pump 40 should pull recovery well 18 down to 25 inches of mercury vacuum maximum. In shallow wells, such a vacuum may be sufficient to cause crude oil 10 to rise up through casinghead. When this occurs, oil may be drawn off by valve 50 in flange of casinghead as indicated in FIG. 1. Valve 50 will draw off crude oil 10 when vacuum in chamber 30 is sufficient to draw crude oil 10 up to flange of casinghead 44. Optionally, pump 38 can be used in conjunction with vacuum pump 40 to remove crude oil 10 through casinghead 44. After a sufficient volume of crude oil 10 has accumulated, batch collection may be used. In the alternative, continuous removal of crude oil 10 through valve 50 or pump 38 is available. That is, a level sensor preset at a given level of crude oil 10 in chamber 30 will control pump 38 operation to maintain the preset level of crude oil 10.

The description set out above describes the preferred embodiment of the enhanced oil recovery process. It is intended, however, that this disclosure and the claims that follow include all obvious variations thereof.

I claim:

1. A process for enhancing recovery of crude oil from a producing formation comprising the steps of:

drilling a first hole and at least one second hole from a surface of the ground into said producing formation;

blasting with suitable charges said producing formation by introducing into said producing formation through said second hole said suitable charges and then detonating said suitable charges;

removing from said first hole rubble created by said blasting, creating thereby a recovery chamber in said first hole within said producing formation;

casing said first hole from said surface through an overburden and into said producing formation;

drilling at least one third hole;

injecting under pressure into said producing formation through said third hole a liquid hydrocarbon solvent heated to a temperature greater than temperature of said crude oil;

evacuating gas from said recovery chamber by means of a vacuum pump;

withdrawing said crude oil from said recovery chamber, said heated and pressure injected hydrocarbon solvent reducing viscosity of said crude oil and enhancing flow of said crude oil from a higher pressure in a region near said third hole to a lower pressure in said recovery chamber below said first hole.

2. The process as described in claim 1 wherein said step of casing said first hole is followed by a second drilling in said first hole, said second drilling extending through said producing formation into an underlying formation.

3. The process as described in claim 1 wherein said step of drilling said second hole is followed by a step of stemming said second hole, said stemming being permanent and occurring before said blasting step.

4. The process as described in claim 1 including a second blasting, said second blasting following said drilling of said third hole, said second blasting including detonation of a second suitable charge after placement into said producing formation through said third holes, said second blasting creating fractures and gas generation, thereby increasing flow of said crude oil.

5. The process as described in claim 1 wherein said drilling of said second hole occurs within a radius of ten (10) feet of where a longitudinal axis of said first hole intersects a plane of said surface.

6. The process as described in claim 5 above wherein said second hole is a plurality of at least three (3) holes and located substantially equidistant from one another along a circumference of a first circle.

7. The process as described in claim 1 above including a step of mixing a surfactant with said liquid hydrocarbon solvent prior to said injecting, said surfactant breaking a water-oil bond and thereby increasing flow of said crude oil.

8. The process as described in claim 1 wherein said liquid hydrocarbon solvent consists of diesel fuel.

9. The process as described in claim 7 wherein said liquid hydrocarbon solvent consists of diesel fuel.

10. The process as described in claim 1 wherein said withdrawing step includes a step of inserting an inlet for a pump into said first hole to below a level of said crude oil in said recovery chamber, said pump for said withdrawing of said crude oil from said producing formation.

11. The process as described in claim 1 wherein said withdrawing occurs continuously, being controlled to maintain a constant level of said crude oil in said chamber.

12. The process as described in claim 6 wherein said drilling of said third hole includes a multiple of said drillings of said third holes, said third holes being located substantially equidistant from one another along a circumference of a circle having radius of approximately thirty (30) feet, this second circle having an origin at an intersection of a longitudinal axis of said first hole with said surface.

13. The process as described in claim 12 wherein said third holes are also drilled along a circumference of a third circle radius of approximately sixty (60) feet, said third circle having an origin at an intersection of a longitudinal axis of said first hole and said surface.

14. The process as described in claim 1 wherein said injecting is directionally controlled.

15. The process as described in claim 14 wherein said injecting is first directed toward said first hole and up to 90° of either side of a radial line connecting said first hole and said third hole and, after flow of said crude oil has been established, said injecting then being directed away from said first hole and up to 90° of either side of a radial line connecting said first hole and said third hole.

16. The process as described in claim 15 wherein said injecting is performed by nozzles attached to an injecting assembly, said nozzles being located within said producing formation and raised and lowered within said producing formation by raising and lowering said injecting assembly whereby substantially all of said producing formation in a region near said injecting is subject to said injecting.

17. A process for enhancing recovery of crude oil from a producing formation having heavy, viscous crude oil and low porosity comprising the steps of:

first drilling of a recovery well, said first drilling penetrating an overburden and continuing through said producing formation into an underlying formation;

casing said recovery well throughout said overburden and partially into said producing formation;

second drilling of a plurality of shot holes within an area transcribed by a circle of an approximate radius of six (6) feet, said circle with an origin at an intersection of a longitudinal axis of said recovery well with a surface of the ground, said second drilling extending substantially into said producing formation;

first setting of a suitable first blasting charge into said shot holes to a depth exceeding an upper surface of said producing formation;

first stemming of said shot holes;

first blasting by detonation of said first blasting charge;

removal of rubble from said producing formation through said recovery well and creating a recovery chamber thereby, said recovery chamber being within said producing formation;

third drilling of an injecting hole, said third drilling in an area removed from said shot holes, said injecting hole extending through said producing formation;

second setting of suitable second blasting charges into said injecting hole and adjacent to said producing formation;

second stemming of said injecting holes;

second blasting, said second blasting being sequential in nature wherein said injecting holes nearest said recovery well are detonated first and said injecting holes located farthest from said recovery well are detonated last;

redrilling of said injecting holes through said stemming and into said producing formation;

sleeving said injecting holes through said overburden;

inserting a pump inlet into said recovery well to a level below the surface of a liquid in said well for removal of said crude oil therefrom;

closing said recovery well with a casinghead;

evacuating a gas from a region above the surface of said crude oil in said recovery well with a vacuum pump in communication with said recovery well;

heating a hydrocarbon solvent/surfactant mixture up to approximately 250° F.;

injecting through said injecting holes said solvent/surfactant mixture at pressures up to 6,000 p.s.i. directionally into said producing formation, said injection being directed substantially towards said recovery well; and removing said crude oil from said evacuated chamber, said flow of said crude oil being induced through said fractured formation towards said recovery chamber by a combination of a pressure differential created by said injecting and said evacuating, with said solvent/surfactant mixture breaking down an oil/water bond, and said heating decreasing the viscosity of said crude oil.

* * * * *